US011808272B2

(12) United States Patent
Kabasawa

(10) Patent No.: US 11,808,272 B2
(45) Date of Patent: Nov. 7, 2023

(54) VACUUM PUMP INCLUDING LEVITATED MAGNETIC BEARING

(71) Applicant: Edwards Japan Limited, Chiba (JP)

(72) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 17/419,087

(22) PCT Filed: Dec. 25, 2019

(86) PCT No.: PCT/JP2019/050886
§ 371 (c)(1),
(2) Date: Jun. 28, 2021

(87) PCT Pub. No.: WO2020/145149
PCT Pub. Date: Jul. 16, 2020

(65) Prior Publication Data

US 2022/0074407 A1 Mar. 10, 2022

(30) Foreign Application Priority Data

Jan. 10, 2019 (JP) ..... 2019-002970

(51) Int. Cl.
*F04D 19/04* (2006.01)
*F04C 2/16* (2006.01)
(Continued)

(52) U.S. Cl.
CPC ..... *F04D 19/042* (2013.01); *F04C 2/16* (2013.01); *F04C 15/0096* (2013.01);
(Continued)

(58) Field of Classification Search
CPC ..... F04D 19/042; F04D 19/048; F04D 19/04; F04D 29/5806; F04D 29/584;
(Continued)

(56) References Cited

U.S. PATENT DOCUMENTS 4,116,592 A 9/1978 Cherny et al.
4,179,075 A * 12/1979 Rachais ..... B02C 13/1807 310/90.5
(Continued)

FOREIGN PATENT DOCUMENTS

EP 2628957 A1 * 8/2013 ..... F04D 19/042
JP S5523403 U 2/1980
(Continued)

OTHER PUBLICATIONS

PCT International Search Report dated Mar. 24, 2020 for corresponding PCT application Serial No. PCT/JP2019/050886, 2 pages.
(Continued)

*Primary Examiner* — Dominick L Plakkoottam
*Assistant Examiner* — Paul W Thiede
(74) *Attorney, Agent, or Firm* — Theodore M. Magee; Westman, Champlin & Koehler, P.A.

(57) ABSTRACT

A pressure difference of liquid is generated between an upper end and a lower end of a thread groove by the action of a thread groove pump formed between the thread groove and a lower end wall portion of a rotating rotor shaft. As a result, liquid of a bottom space is sucked up and passes through a hollow hole and is discharged to the outside of the rotor shaft through communication holes. The discharged liquid passes through the inside of a hub of a rotating body and reaches an extension member where it is sprayed radially in the form of droplets from a protrusion. The droplets are received by a partition wall. Due to the presence of a protrusion in an upper portion of the partition wall, the droplets cannot cross over the partition wall. The accumulated liquid drops through a communication hole to the bottom space.

10 Claims, 6 Drawing Sheets

(51) Int. Cl.
*F04C 15/00* (2006.01)
*F04D 29/58* (2006.01)

(52) U.S. Cl.
CPC ..... *F04D 19/048* (2013.01); *F04C 2240/20* (2013.01); *F04C 2240/50* (2013.01); *F04C 2240/603* (2013.01); *F04D 19/04* (2013.01); *F04D 29/584* (2013.01); *F04D 29/5806* (2013.01); *F04D 29/5846* (2013.01); *F05D 2240/61* (2013.01)

(58) Field of Classification Search
CPC .... F04D 29/5846; F04C 2/16; F04C 15/0096; F04C 2240/20; F04C 2240/50; F04C 2240/603; F05D 2240/61; B02C 13/1807
See application file for complete search history.

(56) References Cited

U.S. PATENT DOCUMENTS

| | | | | |
|---|---|---|---|---|
| 4,767,265 | A * | 8/1988 | Osterstom | F04D 19/042 384/114 |
| 2005/0271528 | A1 | 12/2005 | Stones | |
| 2005/0271532 | A1 | 12/2005 | Chung et al. | |
| 2011/0123328 | A1 * | 5/2011 | Henry | F04D 19/048 415/229 |
| 2017/0306967 | A1 * | 10/2017 | Kozaki | F04D 27/001 |
| 2018/0023577 | A1 | 1/2018 | Rudge | |

FOREIGN PATENT DOCUMENTS

| | | | | |
|---|---|---|---|---|
| JP | S5993978 | A | 5/1984 | |
| JP | S59144815 | A | 8/1984 | |
| JP | S6146615 | | 3/1986 | |
| JP | S62156190 | | 10/1987 | |
| JP | H0219694 | A | 1/1990 | |
| JP | 2003184785 | A | 7/2003 | |
| JP | 2005320905 | A | 11/2005 | |
| JP | 2006266248 | A * | 10/2006 | F04D 19/042 |
| JP | 2008095746 | A | 4/2008 | |
| JP | 2014051952 | A | 3/2014 | |
| JP | 2017053277 | A | 3/2017 | |

OTHER PUBLICATIONS

PCT International Written Opinion dated Mar. 24, 2020 for corresponding PCT application Serial No. PCT/JP2019/050886, 4 pages.
European Communication dated Sep. 5, 2022 for corresponding EP application Serial No. 19909335.2, 10 pages.

* cited by examiner

VACUUM PUMP INCLUDING LEVITATED MAGNETIC BEARING

CROSS-REFERENCE OF RELATED APPLICATION

This application is a Section 371 National Stage Application of International Application No. PCT/JP2019/050886, filed Dec. 25, 2019, which is incorporated by reference in its entirety and published as WO 2020/145149A1 on Jul. 16, 2020 and which claims priority of Japanese Application No. 2019-002970, filed Jan. 10, 2019.

BACKGROUND OF THE INVENTION

The present invention relates to a vacuum pump, and particularly to a vacuum pump capable of not only preventing damage to a rotating body thereof by preventing overheating of the rotating body, but also exhausting a large amount of gas continuously.

With the recent development of electronics, the demand for semiconductors such as memories and integrated circuits has been increasing rapidly.

These semiconductors are each manufactured by doping an extremely pure semiconductor substrate with impurities to give electrical properties to the semiconductor substrate or by etching a fine circuit onto the semiconductor substrate.

These tasks need to be performed in a high vacuum chamber in order to avoid the impact of dust and the like in the air. Typically, a vacuum pump is used for exhausting such a chamber, and particularly a turbomolecular pump, a type of vacuum pump, is frequently used from the viewpoint of low residual gas, easy maintenance, and the like.

A semiconductor manufacturing process includes a large of number of steps in which a variety of process gases are caused to act on a semiconductor substrate; a turbomolecular pump is used not only to evacuate the chamber but also to exhaust these process gases from the chamber.

Incidentally, in some cases the process gases are introduced into the chamber at high temperature to increase the reactivities of the process gases.

When these process gases are cooled to a certain temperature when exhausted, the process gases become solid and may precipitate products in the exhaust system. In some cases these types of process gases become solid at a low temperature in the turbomolecular pump and stick to and accumulate inside the turbomolecular pump.

The accumulation of the precipitates of the process gases inside the turbomolecular pump narrows a pump flow path, leading to a decrease in performance of the turbomolecular pump.

In order to solve this problem, in the prior art, a heater or an annular water cooling pipe is wrapped around an outer circumference of a base portion or the like of a turbomolecular pump, and, for example, a temperature sensor is embedded in the base portion or the like, wherein heating by the heater or cooling by the water cooling pipe is controlled in such a manner that the temperature of the base portion is kept at a high temperature within a certain range on the basis of a signal from the temperature sensor.

The higher the control temperature, the more difficult it is for the products to accumulate. Thus, it is preferred that this temperature be as high as possible.

When the base portion is heated to a high temperature as described above, rotor blades may exceed a threshold temperature when an exhaust load fluctuates or the ambient temperature changes to a high temperature.

In this regard, in a vacuum pump with ball bearings, for example, since a rotating body and a stator part are in contact with each other at the bearing part, heat dissipation is expected to occur therefrom.

In a magnetic bearing vacuum pump, on the other hand, heat dissipation does not occur because a rotating body thereof is supported by magnetic force in a non-contact manner. Therefore, such vacuum pump faces the challenge of releasing the compression heat generated on the rotating body by the compression of a process gas, the frictional heat generated when the process gas comes into contact with or collide with the rotating body, and the heat generated by a motor of the vacuum pump.

In order to cope with this challenge, in the prior art, a high emissivity coating is applied to the rotor blades and stator blades to facilitate radiant heat transfer (see Japanese Patent Application Laid-Open No. 2005-320905). Alternatively, a spacer is provided between the inner circumferential surfaces of the rotor blades and the outer circumferential surface of the stator to reduce the gap therebetween, to facilitate heat dissipation through the gas (see Japanese Patent Application Laid-Open No. 2003-184785).

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

Unfortunately, the radiant heat transfer described in Japanese Patent Application Laid-Open No. 2005-320905 and the heat dissipation through the gas described in Japanese Patent Application Laid-Open No. 2003-184785 are not enough to ensure a sufficient radiation amount. For this reason, in the prior art, the flow rate of the gas exhausted by the pump needs to be limited in order to prevent damage resulting from overheating of the rotating body, which makes it difficult to put the primary capacity of the pump to full use.

Particularly in recent years, in order to prevent the accumulation of reaction products in the pump as described above, pumps are configured such that the peripheral parts functioning as the flow paths are kept warm, which makes it more and more difficult to dissipate the heat from the rotating body to the peripheral parts.

The present invention was contrived in view of the foregoing problems of the prior art, and an object of the present invention is to provide a vacuum pump capable of not only preventing damage to a rotating body thereof by preventing overheating of the rotating body, but also exhausting a large amount of gas continuously.

Therefore, an embodiment of the present invention is a vacuum pump, comprising: a rotor blade; a rotor shaft fixed to the rotor blade and having a communication passage by which a shaft end and a shaft outer peripheral portion are communicated with each other; a magnetic bearing supporting the rotor shaft in a levitated manner in the air; a rotary drive means for driving the rotor shaft to rotate; a liquid storage portion in which liquid is stored; and a liquid transport mechanism that sends out the liquid stored in the liquid storage portion from the shaft outer peripheral portion through the communication passage in response to rotary drive of the rotary drive means.

Liquid is stored in the liquid storage portion. The rotor shaft is driven to rotate by the rotary drive means. Consequently, the liquid transport mechanism sends out the liquid stored in the liquid storage portion from the shaft outer peripheral portion through the communication passage. The liquid that has been sent out flows through the rotor shaft and the rotor blade.

As a result, compression heat or frictional heat that is generated when the pump is operated can be removed, preventing overheating of the rotor blade and damage thereto.

In addition, a large amount of gas can be exhausted continuously, reducing the waiting time of a semiconductor manufacturing apparatus or a flat panel manufacturing apparatus and increasing the production output.

A further embodiment of the present invention is the vacuum pump in which the liquid transport mechanism includes an insertion member inserted into the communication passage of the shaft end of the rotor shaft, and a spiral groove formed on either a peripheral wall around the shaft end of the rotor shaft or the insertion member.

The spiral groove formed on either the peripheral wall around the shaft end of the rotor shaft or the insertion member causes the action of a thread groove pump. As a result, a pressure difference of the liquid is generated between both ends of the spiral groove.

Therefore, the liquid stored in the liquid storage portion can reliably be delivered through the communication passage, with a simple structure.

A further embodiment of the present invention is the vacuum pump in which the liquid transport mechanism includes a tapered peripheral wall formed around the communication passage of the shaft end of the rotor shaft.

As the rotor shaft rotates, a pressure component along a wall surface functions as a transportation power on the liquid. Therefore, the liquid stored in the liquid storage portion can reliably be delivered through the communication passage, with a simple structure.

In a further embodiment of the present invention, an end portion of the communication passage leading to the shaft outer peripheral portion is disposed in the vicinity of a tightening portion between the rotor shaft and the rotor blade.

Accordingly, the liquid that has been sent out through the communication passage flows through the rotor blade easily. As a result, the rotor blade is cooled easily.

In a further embodiment of the present invention, an end portion of the communication passage leading to the shaft outer peripheral portion is disposed in the vicinity of or below an upper end of the magnetic bearing.

Thus, the liquid that has been sent out through the communication passage flows through an outer periphery of the rotor shaft easily. As a result, the rotor shaft is cooled easily.

A further embodiment of the present invention is the vacuum pump further comprising a recovery passage through which the liquid is returned to the liquid storage portion via the outside of the magnetic bearing and of the rotary drive means.

Therefore, the liquid can be reused.

A further embodiment of the present invention is the vacuum pump further comprising a cooling means for cooling the liquid storage portion.

Therefore, the effect of cooling the liquid can be enhanced.

In a further embodiment of the present invention, the cooling means is at least either a water cooling pipe or a heatsink.

In a further embodiment of the present invention, at least either the rotor shaft or the rotor blade is provided with a radial protrusion.

Rotating the radial protrusion causes the liquid to be sprayed radially in the form of droplets from this protrusion. Therefore, the liquid does not leak through an exhaust passage.

Also, in a further embodiment of the present invention, a partition wall is formed in a fixed portion located on an outer periphery of the protrusion.

The droplets are received by the partition wall. The droplets do not cross over the partition wall; therefore, the liquid does not leak through the exhaust passage. Consequently, the liquid is returned to the liquid storage portion. The liquid that has circulated can be reused without decreasing much in amount.

According to the present invention described above, the vacuum pump includes the liquid transport mechanism that sends out the liquid stored in the liquid storage portion from the shaft outer peripheral portion through the communication passage in response to the rotational drive by the rotary drive means. Therefore, the liquid that has been sent out flows through the rotor shaft and the rotor blade.

As a result, compression heat or frictional heat that is generated when the pump is operated can be removed, preventing overheating of the rotor blade and damage thereto.

In addition, a large amount of gas can be exhausted continuously, reducing the waiting time of a semiconductor manufacturing device or a flat panel manufacturing device and increasing the production output.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

Figure 1:
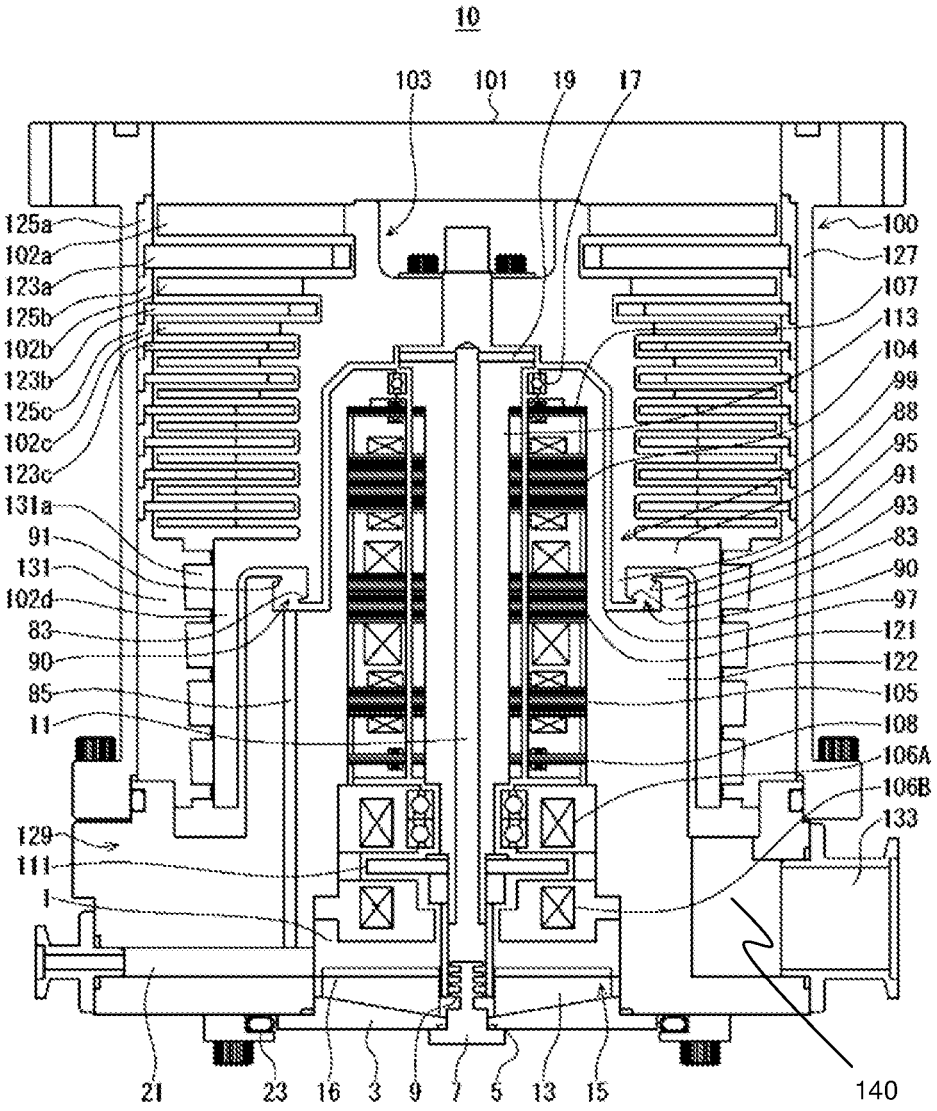
FIG. 1 is a configuration diagram of a turbomolecular pump, which is a first embodiment of the present invention.

A first embodiment of the present invention is described hereinafter. FIG. 1 shows a configuration diagram of a turbomolecular pump, which is a first embodiment.

In FIG. 1, an inlet port 101 is formed at an upper end of a cylindrical outer cylinder 127 of a pump body 100 of a turbomolecular pump 10. A rotating body 103 in which a plurality of rotor blades 102*a*, 102*b*, 102*c*, etc. are formed radially in multiple stages on a peripheral portion of a hub 99 is provided inside the outer cylinder 127, the rotor blades being configured as turbine blades for drawing and exhausting a gas.

A rotor shaft 113 is attached to the center of the rotating body 103. The rotor shaft 113 is supported in a levitated manner in the air and has the position thereof controlled by, for example, a so-called 5-axis control magnetic bearing.

Upper radial electromagnets 104 are four electromagnets arranged in pairs along an X-axis and a Y-axis that are radial coordinate axes of the rotor shaft 113 and are perpendicular to each other. Four upper radial displacement sensors 107 provided with coils are provided in the vicinity of the upper radial electromagnets 104 so as to correspond thereto. The upper radial displacement sensors 107 are configured to detect a radial displacement of the rotor shaft 113 and send the radial displacement to a controller, not shown.

On the basis of the displacement signal detected by the upper radial displacement sensors 107, the controller controls the excitation of the upper radial electromagnets 104 via a compensation circuit having a Proportional, Integral and Derivative (PID) adjustment function, and adjusts an upper radial position of the rotor shaft 113.

The rotor shaft 113 is made of a high magnetic permeability material (such as iron) and configured to be attracted by the magnetic force of the upper radial electromagnets 104. Such adjustment is performed in an X-axis direction and a Y-axis direction independently.

Lower radial electromagnets 105 and lower radial displacement sensors 108 are arranged in the same manner as the upper radial electromagnets 104 and the upper radial displacement sensors 107, to adjust a lower radial position of the rotor shaft 113 as with the upper radial position of the rotor shaft 113.

Furthermore, axial electromagnets 106A and 106B are arranged so as to vertically sandwich a disc-shaped metal disc 111 provided under the rotor shaft 113. The metal disc 111 is made of a high magnetic permeability material such as iron.

Based on an axial displacement signal from an axial displacement sensor, which is not shown, the excitation of the axial electromagnets 106A and 106B is controlled via the compensation circuit of the controller that has the PID adjustment function. The axial electromagnet 106A and the axial electromagnet 106B use the magnetic forces thereof to attract the metal disc 111 upward and downward respectively.

In this manner, the control device is configured to appropriately adjust the magnetic forces of the axial electromagnets 106A and 106B acting on the metal disc 111 to cause the rotor shaft 113 to magnetically float in an axial direction and keep the rotor shaft 113 in the air in a non-contact manner.

A motor 121 has a plurality of magnetic poles that are circumferentially arranged so as to surround the rotor shaft 113. Each of the magnetic poles is controlled by the controller to drive the rotor shaft 113 to rotate by means of electromagnetic force acting between each magnetic pole and the rotor shaft 113.

A plurality of stator blades 123*a*, 123*b*, 123*c*, etc. are arranged with a small gap from the rotor blades 102*a*, 102*b*, 102*c*, etc. The rotor blades 102*a*, 102*b*, 102*c*, etc. are inclined at a predetermined angle from a plane perpendicular to the axis of the rotor shaft 113, in order to transfer molecules of exhaust gas downward by collision.

Similarly, the stator blades 123 are inclined at a predetermined angle from the plane perpendicular to the axis of the rotor shaft 113, and are arranged alternately with the stages of the rotor blades 102 in such a manner as to face inward of the outer cylinder 127.

Ends on one side of the respective stator blades 123 are fitted between and supported by a plurality of stacked stator blade spacers 125*a*, 125*b*, 125*c*, etc.

The stator blade spacers 125 are each a ring-like member and made of a metal such as aluminum, iron, stainless steel, copper, or an alloy containing these metals as components.

The outer cylinder 127 is fixed to an outer periphery of the stator blade spacers 125 with a small gap therefrom. A base portion 129 is disposed at a bottom portion of the outer cylinder 127, and a threaded spacer 131 is disposed between the bottom stator blade spacer 125 and the base portion 129. An outlet port 133 is formed under the threaded spacer 131 in the base portion 129 and communicated with the outside.

The threaded spacer 131 is a cylindrical member made of a metal such as aluminum, copper, stainless steel, iron, or an alloy containing these metals as components, and a plurality of thread grooves 131*a* are engraved in a spiral manner in an inner circumferential surface of the threaded spacer 131.

The direction of the spiral of the thread grooves 131*a* is a direction in which the molecules of the exhaust gas are transferred toward the outlet port 133 when moving in a direction of rotation of the rotating body 103.

An overhanging portion 88 is formed at a lower end of the hub 99 of the rotating body 103 horizontally in the radial direction, and a rotor blade 102*d* hangs down from a circumferential end of the overhanging portion 88. An outer circumferential surface of rotor blade 102*d* is in a cylindrical shape, protrudes toward the inner circumferential surface of the threaded spacer 131, and is positioned in the vicinity of the inner circumferential surface of the threaded spacer 131 with a predetermined gap therefrom.

The base portion 129 is a disk-like member constituting a bottom portion of the turbomolecular pump 10 and typically made of a metal such as iron, aluminum, or stainless steel.

Since the base portion 129 physically holds the turbomolecular pump 10 and functions as a heat conducting path, it is preferred that a metal with rigidity and high thermal conductivity such as iron, aluminum, or copper be used as the base portion 129.

Also, in order to prevent the gas drawn in from the inlet port 101 from entering the electrical part constituted by the motor 121, the lower radial electromagnets 105, the lower radial displacement sensors 108, the upper radial electromagnets 104, the upper radial displacement sensors 107 and the like, the periphery of the electrical part is covered with a stator column 122 and the inside of the electrical part is maintained at a predetermined pressure by purge gas.

An extension member 95 protrudes downward in an annular shape at a lower end of the hub 99 of the rotating body 103 and an inner peripheral end of the annular overhanging portion 88. A protrusion 83 is formed in a circumferential shape at a lower end of the extension member 95 in such a manner as to extend toward the outer periphery in a radial direction.

The lower half of the stator column 122 below a bulging boundary point 97 has a larger diameter than the upper half of the same, the stator column 122 facing the extension member 95.

A circumferential partition wall 93 is provided at an outer peripheral end of the large-diameter portion of the stator column 122 so as to protrude toward the overhanging portion 88. A protrusion 91 is formed in a circumferential shape at a top of the partition wall 93 in such a manner as to extend toward the inner periphery in the radial direction.

Therefore, a liquid retention portion 90 is formed between the bulging boundary point 97 of the stator column 122 and the partition wall 93.

A communication hole 85 is formed between the bulging boundary point 97 of the large-diameter portion of the stator column 122 and the partition wall 93. A bottom space 1 is formed in a central portion of the base portion 129. A bottom lid 3 is disposed so as to seal the bottom space 1. A recess in the shape of an inverted truncated cone is formed in an upper portion of the bottom lid 3. A drain hole 5 is disposed in the center of the bottom lid 3. A detachable drain cap 7 is attached to the drain hole 5. A spiral thread groove 9 is engraved on an outer periphery of an upper portion of the drain cap 7.

A hollow hole 11 having a circularly opened lower end is formed in the center of the rotor shaft 113. The thread groove 9 of the drain cap 7 is inserted into the hollow hole 11 from a lower end of the rotor shaft 113. The space between the thread groove 9 and a lower end wall portion of the rotor shaft 113 functions as a so-called thread groove pump. However, the thread groove 9 may be engraved on the inside of the lower end wall portion of the rotor shaft 113. This thread groove pump corresponds to the liquid transport mechanism. A heatsink 15 provided with a plurality of fins 13 extending radially is disposed inside the bottom space 1. The bottom space 1 is filled with liquid, as shown by a liquid level 16. The bottom space 1 filled with the liquid corresponds to the liquid storage portion.

A protective ball bearing 17 for holding the rotating body 103 when an abnormality occurs in the magnetic bearing is disposed around the upper portion of the rotor shaft 113. Above the protective ball bearing 17, communication holes 19 are formed in the radial direction in the vicinity of the tightening portion between the rotor shaft 113 and the rotor blades 102. The communication holes 19 are connected to the hollow hole 11, and preferably an even number of the communication holes 19 are evenly arranged radially around the hollow hole 11. The communication hole 85 and the bottom space 1 are connected to each other by a through hole 21. A water cooling pipe 23 is embedded around the bottom space 1.

The effects of the first embodiment are described next.

When the rotor blades 102 are driven by the motor 121 and rotate together with the rotor shaft 113, the exhaust gas from a chamber is sucked in through the inlet port 101 by the actions of the rotor blades 102 and the stator blades 123.

The exhaust gas sucked in through the inlet port 101 passes between the rotor blades 102 and the stator blades 123 and is transferred to the base portion 129. The exhaust gas is then ejected from the outlet port 133.

Vacuum oil, for example, which is a fluid having a low vapor pressure even at a low pressure, is used as the liquid introduced into the bottom space 1. This liquid maintains a liquid phase state thereof at the internal pressure of the pump. Note that water cannot be used because water freezes in a vacuum.

In response to the rotation of the rotor shaft 113, a pressure difference of the liquid is generated between the upper end and the lower end of the thread groove 9 by the action of the thread groove pump formed between the thread groove 9 and the lower end wall portion of the rotor shaft 113. As a result, the liquid of the bottom space 1 is sucked up.

The liquid that has been sucked up passes through the hollow hole 11 and is discharged to the outside of the rotor shaft 113 through the communication holes 19. The discharged liquid passes through the inside of the hub 99 of the rotating body 103 and reaches the extension member 95. The liquid flowing around the lower end of the extension member 95 is sprayed radially in the form of droplets from the protrusion 83. The droplets are received by the partition wall 93. Due to the presence of the protrusion 91 in the upper portion of the partition wall 93, the droplets cannot cross over the partition wall 93; thus, the liquid does not flow out to the outside of the stator column 122 and does not leak through an exhaust passage 140.

Therefore, the liquid accumulated in the liquid retention portion 90 drops through the communication hole 85, which is a part of a recovery passage, passes through the through hole 21, and is returned to the bottom space 1. The liquid that has circulated can be reused without decreasing much in amount.

The bottom space 1 is cooled by the water cooling pipe 23. The water cooling pipe 23 may be used together with the one provided to prevent the deposition of precipitates of a process gas. The water cooling pipe 23 may also be embedded in the bottom lid 3. Since the liquid cooled in the bottom space 1 flows while in contact with the inside of the rotor shaft 113 and the inside of the rotor blades 102, the rotating body 103 is cooled efficiently.

Accordingly, compression heat or frictional heat that is generated when the pump is operated is removed, preventing overheating of the rotating body 103 and damage thereto.

In addition, a large amount of gas can be exhausted continuously, reducing the waiting time of a semiconductor manufacturing apparatus or a flat panel manufacturing apparatus and increasing the production output.

Figure 2:
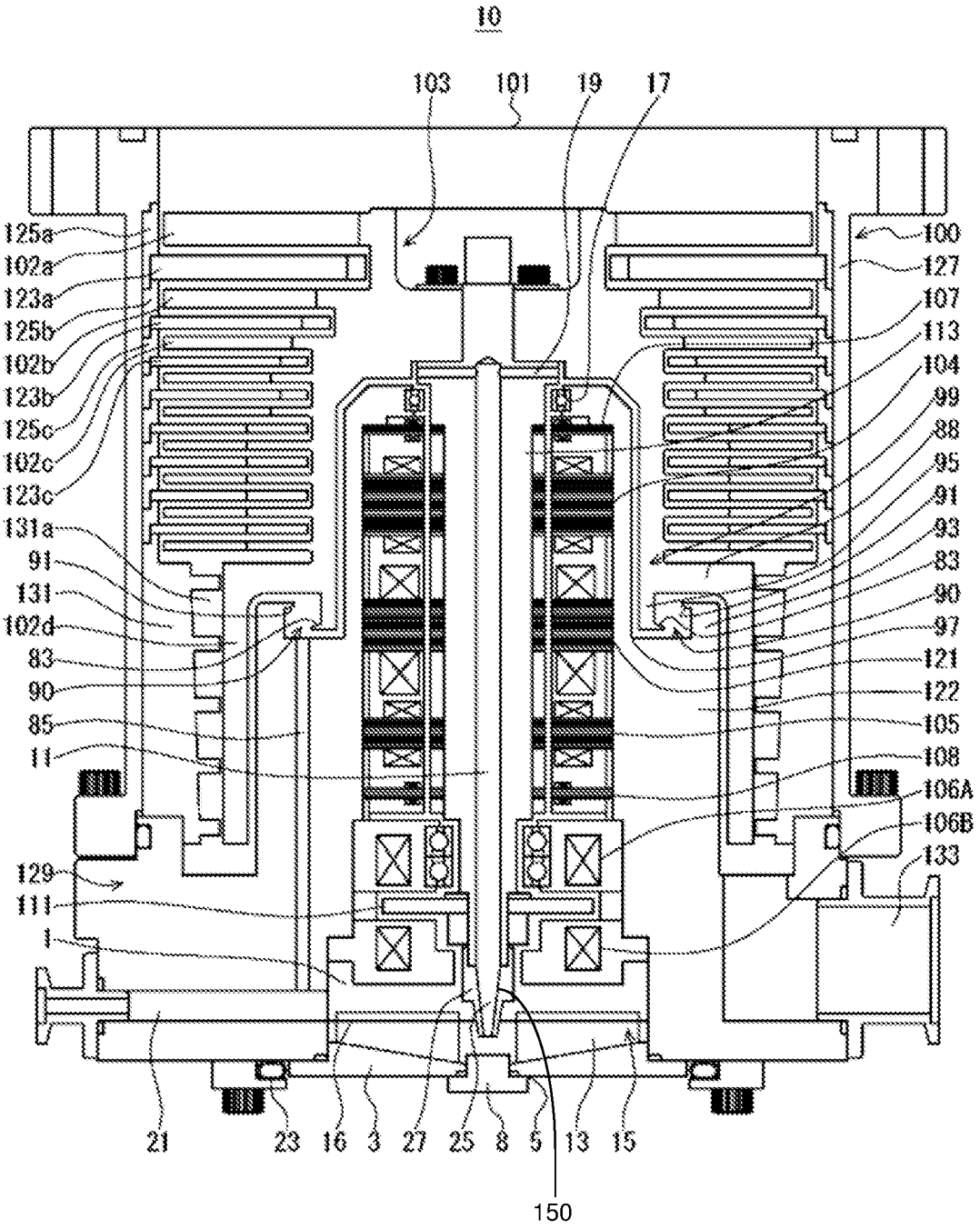
FIG. 2 is a configuration diagram of a turbomolecular pump, which is a second embodiment of the present invention.

A second embodiment of the present invention is described next. FIG. 2 shows a configuration diagram of a turbomolecular pump, which is a second embodiment of the present invention. The same elements as those shown in FIG. 1 are denoted by the same reference numerals; the descriptions thereof will be omitted accordingly. The difference between the second embodiment and the first embodiment is the liquid transport mechanism. While the liquid transport mechanism of the first embodiment has a structure to which the thread groove pump is applied, the liquid transport mechanism of the second embodiment is a pump having a so-called tapered structure that has, on the inside of the liquid transport mechanism, a cavity in the shape of an inverted truncated cone.

Figure 3:
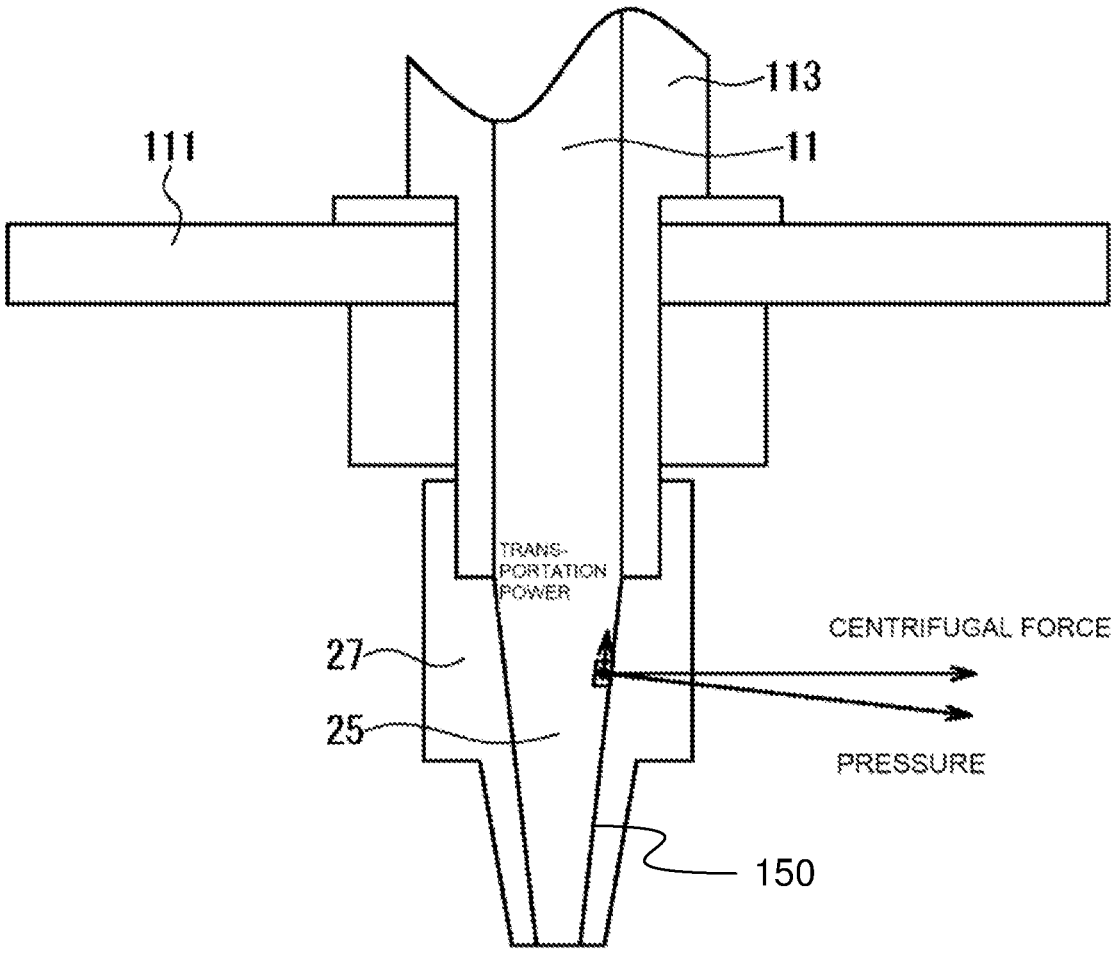
FIG. 3 is an enlarged view showing a periphery of a tapered structure pump.

In FIG. 2, a tapered structure pump 27 in which a cavity 25 in the shape of an inverted truncated cone is formed on the inside thereof is attached to the lower end of the rotor shaft 113. A tapered peripheral wall 150 is formed around cavity 25. The tapered structure pump 27 corresponds to the liquid transport mechanism. The cavity 25 has a circular horizontal cross section and is connected to the hollow hole 11. FIG. 3 is an enlarged view showing a periphery of the tapered structure pump 27. A vertical cross section of the tapered structure pump 27 has a tapered surface that is in contact with the cavity 25. A detachable drain cap 8 is attached to the drain hole 5.

According to this configuration, as shown in FIG. 3, a centrifugal force is generated in the liquid in the radial direction as the rotor shaft 113 rotates. The centrifugal force can be decomposed into a pressure component perpendicular to a wall surface of the tapered structure pump 27 and a pressure component parallel to the wall surface. The pressure component parallel to the wall surface functions as a transportation power. Therefore, the liquid can be circulated in the same manner as in the first embodiment. Accordingly, the same effects as those of the first embodiment are obtained.

Figure 4:
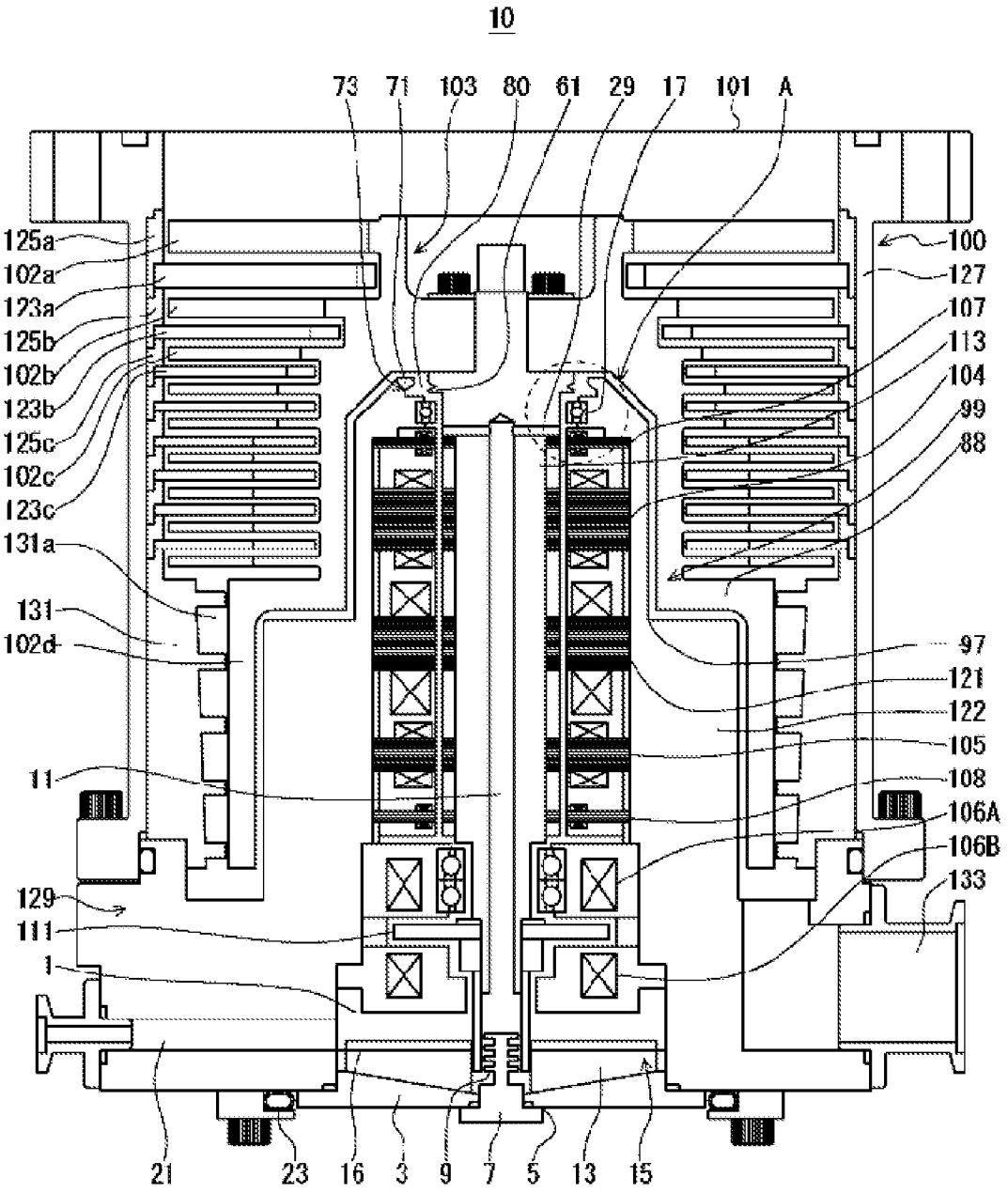
FIG. 4 is a configuration diagram of a turbomolecular pump, which is a third embodiment of the present invention.
Figure 5:
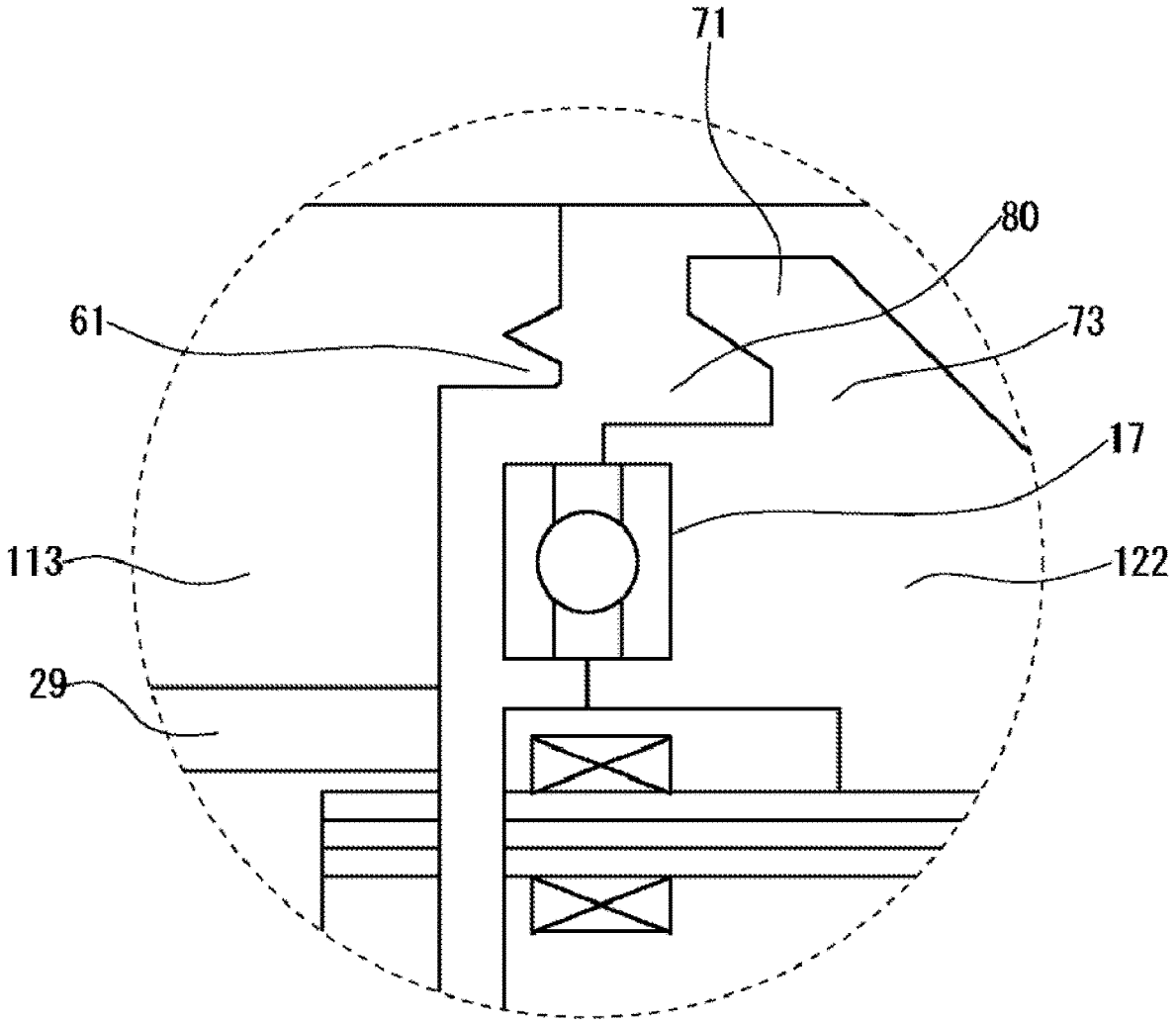
FIG. 5 is an enlarged view showing a region surrounded by a dotted line marked with A in FIG. 4.

A third embodiment of the present invention is described next. FIG. 4 shows a configuration diagram of a turbomolecular pump, which is a third embodiment of the present invention. FIG. 5 shows an enlarged view of a region surrounded by a dotted line marked with A in FIG. 4. The same elements as those shown in FIG. 1 are denoted by the same reference numerals; the descriptions thereof will be omitted accordingly.

The third embodiment adopts a thread groove pump as the liquid transport mechanism, as with the first embodiment. The differences between the third embodiment and the first embodiment are the positions of the communication holes and the location of the liquid retention portion. In the first embodiment, the communication holes 19 are formed above the protective ball bearing 17. In the third embodiment, on the other hand, communication holes 29 are formed below the protective ball bearing 17, that is, in the vicinity of the upper end of the magnetic bearing. However, the communication holes 29 may be formed below the upper end of the magnetic bearing. The liquid ejected from the communication holes 29 flows on the surface of the rotor shaft 113 along the rotor shaft 113. The liquid flowing along the rotor shaft 113 is returned to the bottom space 1.

In this case, the liquid retention portion 80 is formed in a circumferential shape above the protective ball bearing 17 so that the liquid does not leak through the exhaust passage after passing through the inside of the hub 99 of the rotating body 103. Specifically, a circumferential partition wall 73 is provided in a protruding manner, on an upper end portion of the small-diameter portion of the stator column 122 so as to be in parallel to the rotor shaft 113. A protrusion 71 is formed in a circumferential shape at a top of the partition wall 73 in such a manner as to extend toward the inner periphery, in the radial direction. On the other hand, a protrusion 61 is provided in the vicinity of and immediately above the protective ball bearing 17 so as to protrude in the radial direction from the peripheral wall of the rotor shaft 113.

The liquid retention portion 80 is formed between the upper end portion of the stator column 122 and the rotor shaft 113.

Therefore, the rotor shaft 113 is cooled directly by the liquid that flows on the surface of the rotor shaft 113 along the rotor shaft 113, and the rotor blades 102, too, are cooled indirectly by the liquid. Accordingly, the same effects as those of the first embodiment are achieved.

Figure 6:
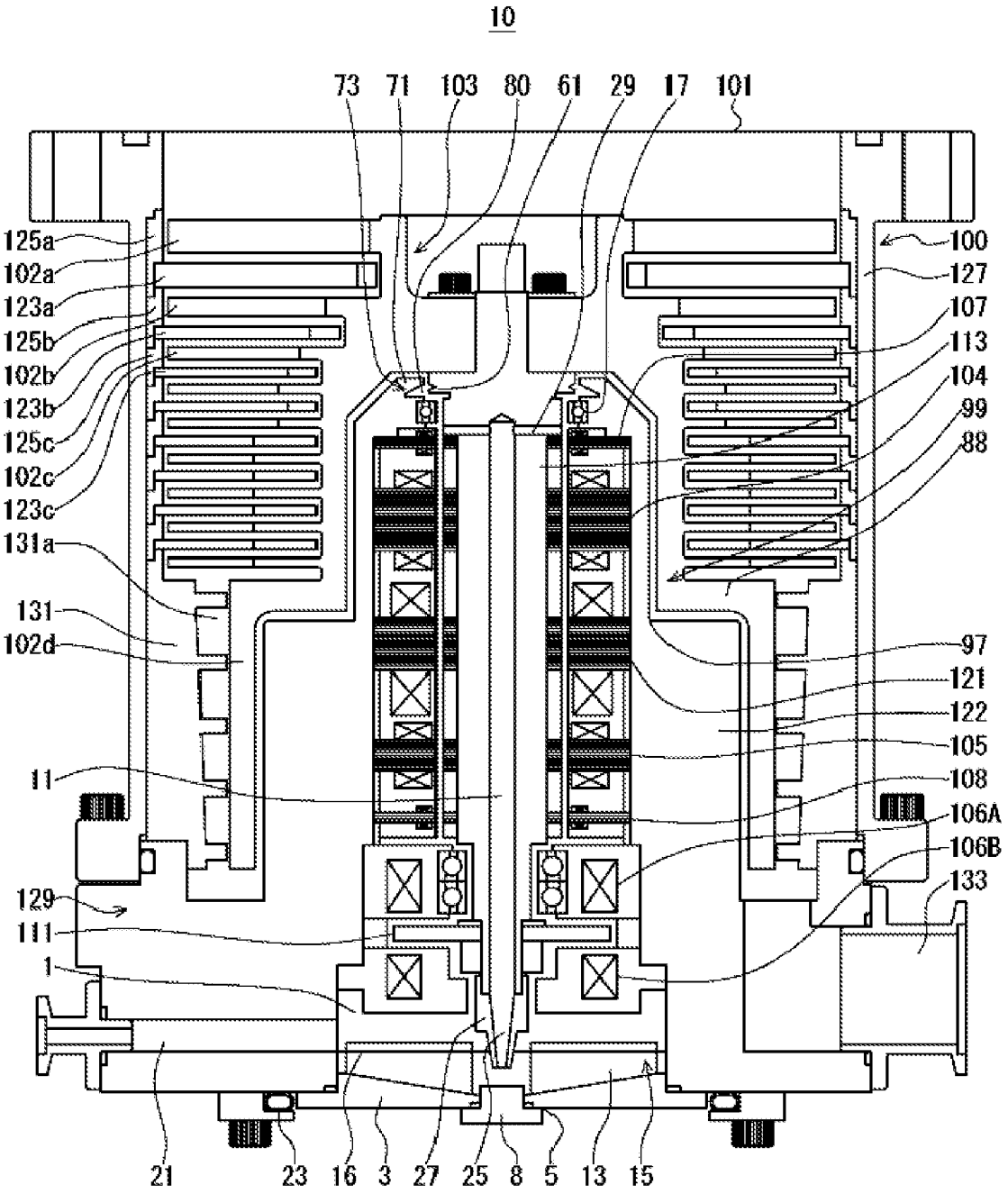
FIG. 6 is a configuration diagram of a turbomolecular pump, which is a fourth embodiment of the present invention.

A fourth embodiment of the present invention is described next. FIG. 6 shows a configuration diagram of a turbomolecular pump, which is a fourth embodiment of the present invention. The same elements as those shown in FIG. 1 are denoted by the same reference numerals; the descriptions thereof will be omitted accordingly. The fourth embodiment adopts a pump of a tapered structure as the liquid transport mechanism, as with the second embodiment. The differences between the fourth embodiment and the second embodiment are the positions of the communication holes and the location of the liquid retention portion. In the second embodiment, the communication holes 19 are formed above the protective ball bearing 17. In the fourth embodiment, on the other hand, the communication holes 29 are formed below the protective ball bearing 17, that is, in the vicinity of the upper end of the magnetic bearing. However, the communication holes 29 may be formed below the upper end of the magnetic bearing. The liquid ejected from the communication holes 29 flows on the surface of the rotor shaft 113 along the rotor shaft 113. The liquid that flows along the rotor shaft 113 is returned to the bottom space 1.

In this case, the liquid retention portion 80 is formed in a circumferential shape above the protective ball bearing 17 so that the liquid does not leak through the exhaust passage after passing through the inside of the hub 99 of the rotating body 103.

Accordingly, the same effects as those of the first embodiment are achieved.

Note that various modifications can be made to the present invention without departing from the spirit of the present invention, and it goes without saying that the present invention extends to such modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a rotor blade;

a rotor shaft fixed to the rotor blade and having a communication passage, a first upper rotor shaft end, and a second lower rotor shaft end opposing the first upper rotor shaft end, the second lower rotor shaft end communicates with the first upper rotor shaft end via the communication passage;

a magnetic bearing supporting the rotor shaft in a levitated manner in the air;

a rotary drive means for driving the rotor shaft to rotate;

a liquid storage portion in which liquid is stored;

a liquid transport mechanism that sends out the liquid stored in the liquid storage portion from the second lower rotor shaft end through the communication passage towards the first upper rotor shaft end in response to rotary drive of the rotary drive means; and a liquid retention portion formed in a recovery passage of the liquid that connects the communication passage to the liquid storage portion, the liquid retention portion preventing a leak of the liquid to an exhaust passage in which exhaust gas exhausted by the rotor blade flows, wherein the liquid flowing in the communication passage of the rotor shaft indirectly cools the rotor blade.

2. The vacuum pump according to claim 1, wherein the liquid transport mechanism includes an insertion member inserted into the communication passage of the second lower rotor shaft end of the rotor shaft, and a spiral groove formed on the insertion member.

3. The vacuum pump according to claim 1, wherein the liquid transport mechanism includes a tapered peripheral wall formed around the communication passage at the second lower rotor shaft end of the rotor shaft.

4. The vacuum pump according to claim 1, wherein the connection of the recovery passage to the communication passage is located at the first upper rotor shaft end.

5. The vacuum pump according to claim 1, wherein the magnetic bearing surrounds the rotor shaft and is positioned between the rotor shaft and the liquid retention portion.

6. The vacuum pump according to claim 1, wherein at least a portion of the recovery passage through which the liquid is returned to the liquid storage portion is disposed radially outbound from the magnetic bearing and the rotary drive means, respectively.

7. The vacuum pump according to claim 1, further comprising a cooling means for cooling the liquid storage portion.

8. The vacuum pump according to claim 7, wherein the cooling means is a water cooling pipe.

9. The vacuum pump according to claim 1, wherein at least either the rotor shaft or the rotor blade is provided with a radial protrusion.

10. The vacuum pump according to claim 9, wherein a partition wall is formed in a fixed portion located on an outer periphery of the protrusion.

* * * * *